United States Patent [19]

Tanaka et al.

[11] Patent Number: 5,007,390

[45] Date of Patent: Apr. 16, 1991

[54] STARTING FUEL SUPPLYING DEVICE FOR INTERNAL COMBUSTION ENGINE

[75] Inventors: Seiichi Tanaka; Tamotsu Suzuki, both of Hamamatsu, Japan

[73] Assignee: Sanshin Kogyo Kabushiki Kaisha, Hamamatsu, Japan

[21] Appl. No.: 563,816

[22] Filed: Aug. 6, 1990

Related U.S. Application Data

[63] Continuation of Ser. No. 303,942, Jan. 30, 1989, abandoned.

[30] Foreign Application Priority Data

Feb. 12, 1988 [JP] Japan ..... 63-30184

[51] Int. Cl.[5] ..... F02M 1/10

[52] U.S. Cl. ..... 123/180 T; 123/179 G; 123/180 E; 123/443

[58] Field of Search ..... 123/180 E, 180 T, 187.5 R, 123/179 G, 179 L, 180 R, 576, 443, 481

[56] References Cited

U.S. PATENT DOCUMENTS

| | | | |
|---|---|---|---|
| 3,704,702 | 12/1972 | Aono | 123/180 T |
| 3,847,130 | 11/1974 | Miyoshi et al. | 123/179 G |
| 4,441,467 | 4/1984 | Powell | 123/179 G |
| 4,676,204 | 6/1987 | Inoguchi et al. | 123/179 G |

FOREIGN PATENT DOCUMENTS

| | | | |
|---|---|---|---|
| 1210249 | 2/1966 | Fed. Rep. of Germany | 123/187.5 R |
| 57-51913 | 3/1982 | Japan | 123/576 |

*Primary Examiner*—Andrew M. Dolinar
*Attorney, Agent, or Firm*—Ernest A. Beutler

[57] ABSTRACT

Several embodiments of starting fuel supply devices for internal combustion engines wherein starting fuel is supplied to the engine in response to operation of the engine starter motor. In some embodiment, the amount of fuel supplied is varied by either a variable valve or a variable pump and in another embodiment the amount of fuel supplied is varied by varying the number of cylinders of the engine which are provided with starting fuel.

7 Claims, 3 Drawing Sheets

STARTING FUEL SUPPLYING DEVICE FOR INTERNAL COMBUSTION ENGINE

This is a continuation of U.S. patent application Ser. No. 303,942, filed Jan. 30, 1989, now abandoned.

BACKGROUND OF THE INVENTION

This invention relates to a starting fuel supplying device for an internal combustion engine and more particularly to an improved system for facilitating the starting of an internal combustion engine.

During the cranking of an engine, it is the normal practice to supply additional fuel so as to facilitate starting. The amount of fuel supplied during starting operation is controlled in conventional systems by means of a choke valve, if the engine is provided with a carburetor. Alternatively, if the engine is supplied with a charge from the fuel injection nozzle, it is normally the practice to provide enrichment by supplying additional fuel to the fuel injection nozzle. However, the amount of fuel required varies in response to ambient temperature and/or the temperature of the engine and the previously proposed starting fuel enrichment devices have not been fully responsive to the engine requirements. As a result, starting is either difficult and/or excess fuel is consumed during starting operation.

It is, therefore, a principle object of this invention to provide an improved starting arrangement for supplying starting fuel to an internal combustion engine.

It is a further object of this invention to provide a starting fuel supplying device that is independent of the normal charge forming system of the engine.

It is a further object of this invention to provide an improved arrangement for supplying starting fuel to an engine in response to operation of its starter and wherein the amount of fuel supplied is dependent upon the temperature.

SUMMARY OF THE INVENTION

This invention is adapted to be embodied in an internal combustion engine having a main charge forming system for supplying a fuel air mixture to the engine and a starter for starting of the engine. In accordance with the invention, means independent of the main charge forming system supplies fuel to the engine for starting in response to operation of the starter. Temperature responsive means are incorporated for controlling the amount of starting fuel supplied to the engine.

DETAILED DESCRIPTION OF THE PREFERRED EMBODIMENT OF THE INVENTION

Figure 1:
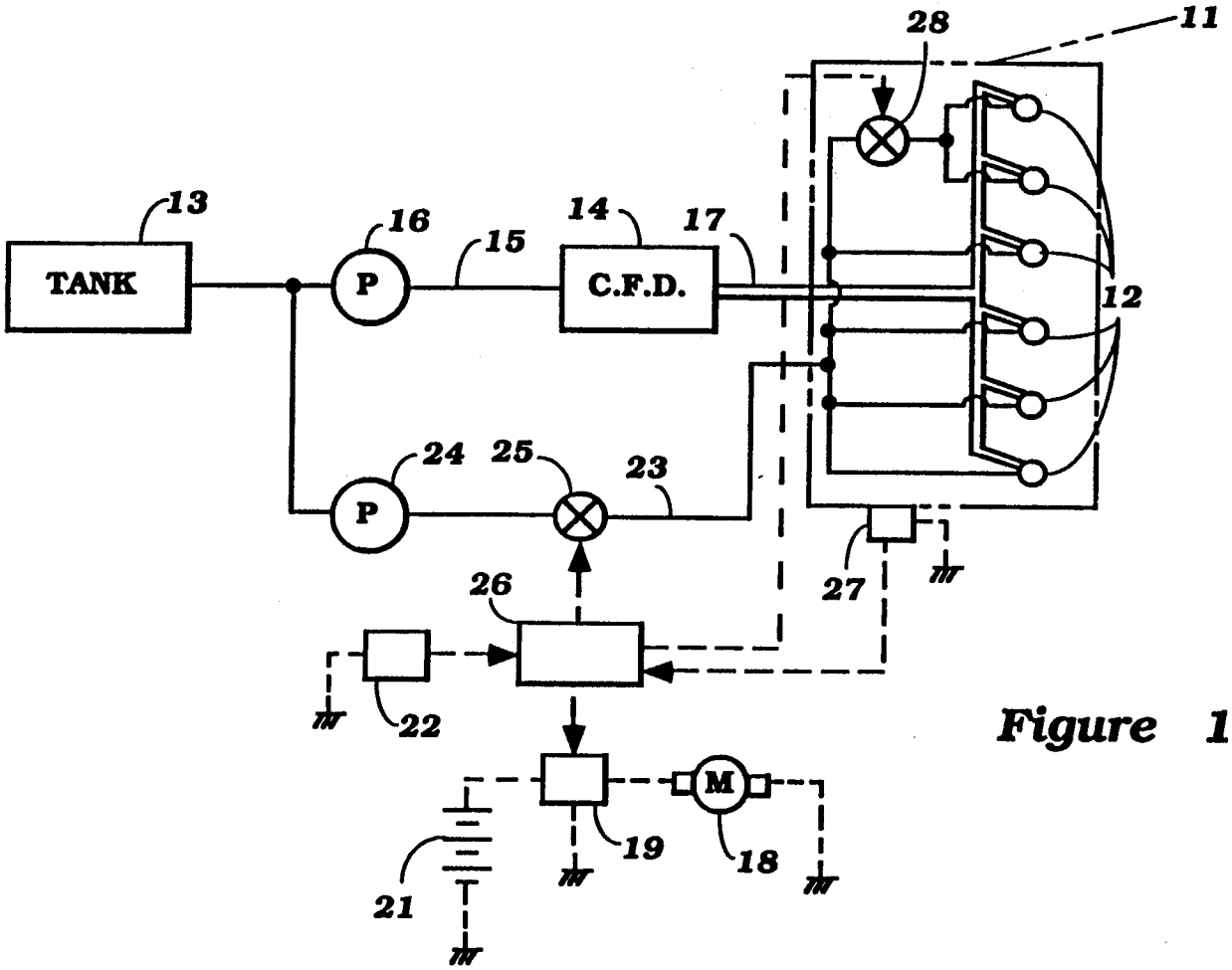
FIG. 1 is a partially schematic view of an internal combustion engine and its fuel supply systems constructed in accordance with a first embodiment of the invention.

Referring first to FIG. 1, an internal combustion engine is illustrated schematically at 11 and is comprised of a plurality of cylinders 12. In the depicted embodiment, the engine 11 is as utilized in an outboard motor and, for that reason, the cylinders 12 are disposed so that they extend horizontally. It is to be understood, however, that the invention may be employed with other applications for internal combustions engines.

The engine 11 is provided with a main fuel system that is comprised of a remotely positioned fuel tank 13 that supplies fuel to a charge forming device 14, such as one or more carburetors, through a conduit 15 in which a pump 16 is interposed. The charge forming device 14 supplies fuel to the individual cylinders 12 through a manifold 17.

The engine 11 is also provided with an electrical starter that is comprised of a starter motor 18 that cranks the engine 11 through a suitable starter gear (not shown). The starter motor 18 is energized by a solenoid 19 to supply electrical power from a battery 21. A starter circuit including a starter switch 22 is interrelated with the solenoid 19, in a manner to be described, so as to control the operation of the starter motor 18.

In accordance with the invention, a starter fuel supplying circuit is provided for supplying additional fuel to the engine 11 for starting in response to operation of the starter motor 18 and when the temperature conditions require it. To this purpose, there is provided a separate fuel supplying line 23 that supplies fuel to the individual cylinders 12 in a suitable manner as by means of simple charge forming devices or separate injection nozzle. The fuel is supplied to the conduit 23 under pressure from the tank 13 by means of an auxiliary starter pump 24 and a solenoid operated control valve 25. The control valve 25 is operated by a control device 26 that receives an input signal from the starter circuit 22 and also a temperature signal from an engine temperature sensor 27. In order to control the amount of starting fuel supplied to the cylinders 12, there is provided a further solenoid valve 28 which will shut off the supply of fuel to selected ones of the cylinders 12 when the ambient temperature sensed by the temperature sensor 27 is high enough to indicate that additional enrichment is not required.

Figure 2:
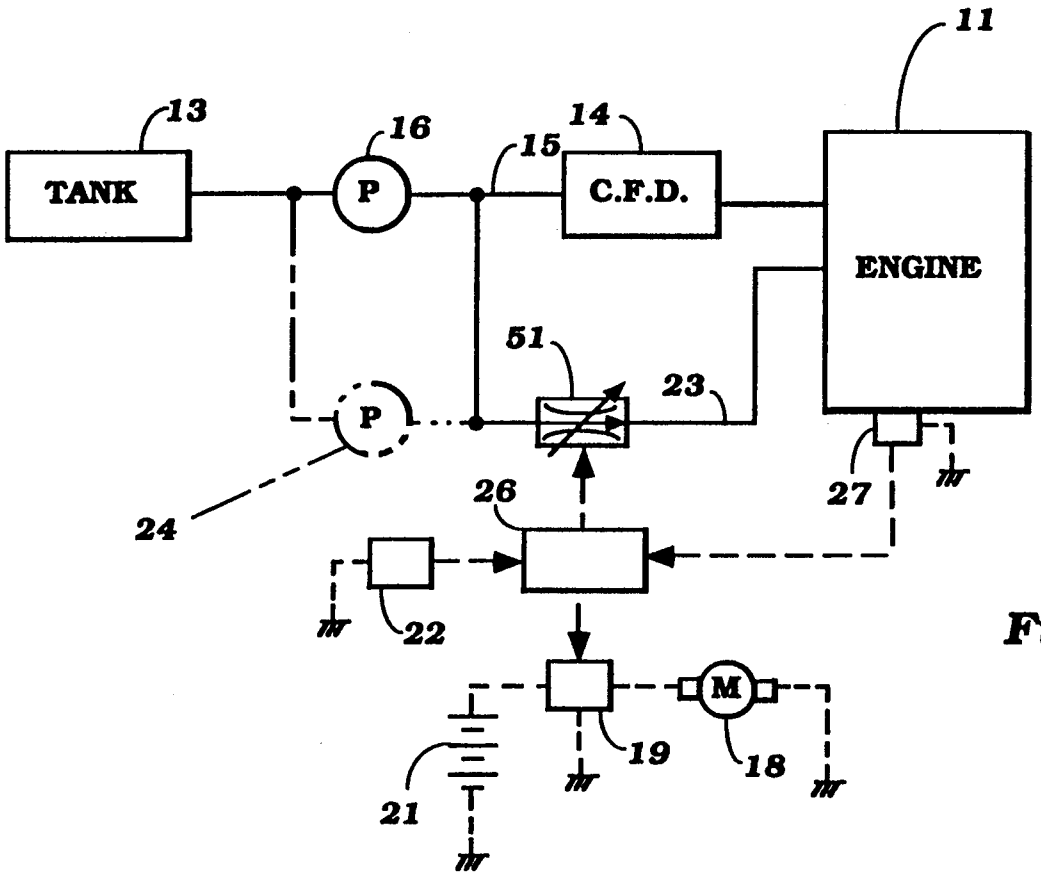
FIG. 2 is a schematic view, in part similar to FIG. 1, showing a second embodiment.

FIG. 2 shows another embodiment of the invention that is generally similar to the embodiment of FIG. 1. For this reason, components of this embodiment which are the same as those of the previously described embodiment have been identified by the same reference numeral. In this embodiment, rather than providing the paired solenoid valves 25 and 28, the control device 26 controls the amount of fuel supplied to the engine for starting by controlling a variable orifice valve 51 that is supplied in the line 23 down stream of the pump 24. At lower temperatures, the valve 51 is operated so as to provide a greater amount of fuel when the starting circuit 22 is energized. As the temperature increases, the amount of fuel supplied is decreased. In all other regards, this embodiment is the same as the previously described embodiment and, for that reason, further description is not believed to be required.

Figure 3:
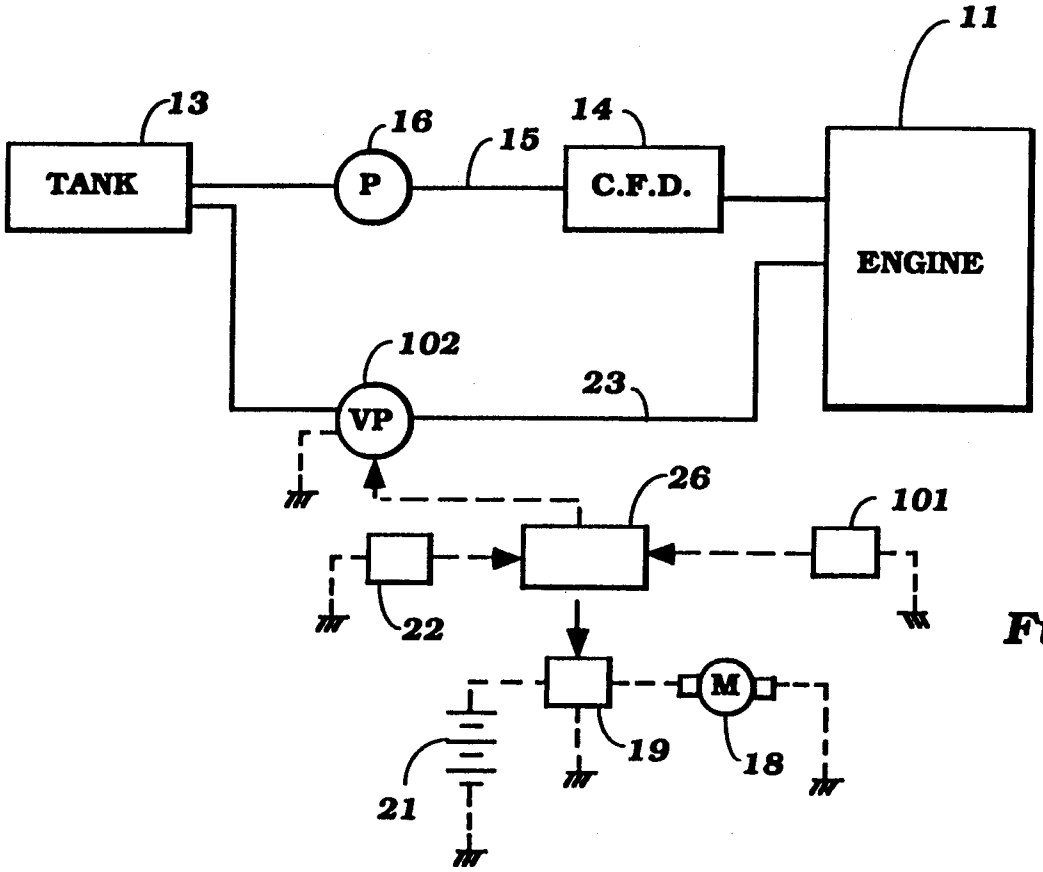
FIG. 3 is a schematic view in part similar to FIGS. 1 and 2, showing a third embodiment.

FIG. 3 shows yet another embodiment of the invention. In this embodiment, a temperature sensing device 101 is positioned in proximity to but not in direct contact with the engine 11. Therefore, in this embodiment, the temperature sensing device 101 will sense ambient rather than engine temperature. Such an arrangement may be utilized with the enrichment starting circuits of the embodiments shown in FIGS. 1 and 2.

In addition, the amount of starting fuel supplied to the engine 11 through the conduit 23 is controlled by means of a variable speed electrical pump 102 that is interposed in the line 23 to the tank 13. The lower the temperature, the faster the pump 102 will be driven by the control circuit 26 so as to provide a greater amount of fuel as the ambient temperature decreases. In other regards, this embodiment is the same as those previously described and, for that reason, further description of it is not believed to be necessary.

It should be readily apparent from the foregoing description that several embodiments of the invention have been illustrated and described each of which is very effective in providing an amount of fuel for starting dependent upon temperature so as to insure good starting. Although several embodiments of the invention have been illustrated and described, various changes and modifications made be made without departing from the spirit and scope of the invention, as defined by the appended claims.

What is claimed is:

1. In an internal combustion engine having a plurality of combustion chambers and a main charge forming system for supplying a fuel air mixture to all combustion chambers of said engine, the improvement comprising means independent of said main charge forming system for supplying supplemental fuel to said engine, and temperature responsive means for controlling the amount of supplemental fuel supplied to said engine by controlling the number of combustion chambers to which fuel is supplied.

2. An internal combustion engine as set forth in claim 1, further including a starter for starting the engine and means for supplying supplemental fuel to the engine for starting in response to operation of said starter through said means independent of said main charge forming system.

3. In an internal combustion engine as set forth in claim 2 wherein the starter is electrically operated.

4. In an internal combustion engine as set forth in claim 3 wherein the means for supplying starting fuel is responsive to the operation of the starter circuit of the starter.

5. An internal combustion engine having a plurality of combustion chambers and a main charge forming system for supplying a fuel air mixture to all combustion chambers of said engine and a starter for starting said engine, the improvement comprising means for supplying fuel to said engine in addition to normal running fuel for starting and in response to operation of said starter, and temperature responsive means for controlling the amount of starting fuel supplied to said engine by controlling the number of combustion chambers to which fuel is supplied.

6. An internal combustion engine as set forth in claim 5 wherein the starter is electrically operated.

7. An internal combustion engine as set forth in claim 6 wherein the means for supplying starting fuel is responsive to the operation of the starter circuit of the starter.

* * * * *